US008978413B2

(12) United States Patent
Ha

(10) Patent No.: US 8,978,413 B2
(45) Date of Patent: Mar. 17, 2015

(54) RARE GASES RECOVERY PROCESS FOR TRIPLE COLUMN OXYGEN PLANT

(75) Inventor: Bao Ha, San Ramon, CA (US)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 795 days.

(21) Appl. No.: 12/796,816

(22) Filed: Jun. 9, 2010

(65) Prior Publication Data

US 2011/0302956 A1 Dec. 15, 2011

(51) Int. Cl.
*F25J 3/02* (2006.01)
*F25J 3/04* (2006.01)

(52) U.S. Cl.
CPC ..... *F25J 3/04448* (2013.01); *F25J 3/0429* (2013.01); *F25J 3/04745* (2013.01); *F25J 2200/08* (2013.01); *F25J 2200/32* (2013.01); *F25J 2215/52* (2013.01)
USPC ..... 62/648

(58) Field of Classification Search
CPC . F25J 3/04745; F25J 3/04751; F25J 3/04442; F25J 3/04448; F25J 3/04454; F25J 2200/08; F25J 2200/20; F25J 2215/34; F25J 2215/36
USPC ..... 62/640, 643, 648, 900, 923, 925
See application file for complete search history.

(56) References Cited

U.S. PATENT DOCUMENTS 4,433,989 A * 2/1984 Erickson ..... 62/651
5,231,837 A 8/1993 Ha
5,341,646 A 8/1994 Agrawal et al.

(Continued)

FOREIGN PATENT DOCUMENTS

WO 2004023054 3/2004

OTHER PUBLICATIONS

Cook, Gerhard A., "Argon, Helium, and the Rare Gases", p. 428.

(Continued)

*Primary Examiner* — Frantz Jules
*Assistant Examiner* — Brian King
(74) *Attorney, Agent, or Firm* — Justin K. Murray

(57) ABSTRACT

The present invention is a process for recovering rare gases from a multiple column oxygen plant, wherein the multiple column oxygen plant comprises a higher pressure column, a lower pressure column, a middle pressure intermediate column, and a low pressure intermediate column, said middle pressure intermediate column comprising a first bottom reboiler and said low pressure intermediate column comprising a second bottom reboiler. The process includes providing a first oxygen rich liquid stream containing rare gases from the higher pressure column, wherein said first oxygen rich liquid stream is introduced to the first bottom reboiler. The process also includes removing a second oxygen rich liquid stream rich in rare gases from the bottom of the middle pressure intermediate column, wherein said second oxygen rich liquid stream is introduced to the low pressure intermediate column. The process also includes removing a first liquid purge stream concentrated in rare gases is removed from the low pressure intermediate column, wherein said first liquid purge stream is further concentrated downstream. And the process includes removing a third oxygen rich liquid stream lean in rare gases at a location that is at least one tray above the first bottom reboiler, wherein said third oxygen rich liquid stream is introduced to the lower pressure column.

15 Claims, 3 Drawing Sheets

(56) References Cited

U.S. PATENT DOCUMENTS

| | | | | |
|---|---|---|---|---|
| 5,730,004 | A * | 3/1998 | Voit | 62/646 |
| 5,852,940 | A * | 12/1998 | Higginbotham et al. | 62/653 |
| 5,966,967 | A * | 10/1999 | Agrawal et al. | 62/650 |
| 5,970,743 | A * | 10/1999 | Herron et al. | 62/648 |
| 6,220,054 | B1 | 4/2001 | Rathbone | |
| 6,318,120 | B1 * | 11/2001 | Ha | 62/646 |
| 6,351,970 | B1 * | 3/2002 | Hahn et al. | 62/648 |
| 6,564,581 | B2 * | 5/2003 | Pompl | 62/646 |
| 6,612,129 | B2 | 9/2003 | Schwenk | |
| 6,662,593 | B1 | 12/2003 | Higginbothan et al. | |
| 6,776,004 | B2 | 8/2004 | Rottmann et al. | |
| 2003/0110795 | A1 * | 6/2003 | Schwenk | 62/640 |
| 2006/0021380 | A1 * | 2/2006 | Jaouani et al. | 62/643 |

OTHER PUBLICATIONS

Mcketta, John J. Rare Gas Separation and Purification, Encyclopedia of Chemical Processing and Design, vol. 26, p. 184.

* cited by examiner

RARE GASES RECOVERY PROCESS FOR TRIPLE COLUMN OXYGEN PLANT

BACKGROUND

In recent years the demand for rare gases, in particular Krypton and Xenon, is becoming very important. New applications and advances in electronics, medical, glass insulation etc. are greatly contributing to this high demand.

Krypton and Xenon are produced as the by-products of a cryogenic air separation plant. The basic recovery scheme is well known in the art. Since Kr and Xe are heavier than oxygen and will accumulate in liquid oxygen, the recovery technique usually calls for the refining of a liquid oxygen purge stream of the low pressure column of a double column cycle. The rare gases contained in the purge stream are further concentrated in a first concentrating column along with other heavy components in liquid oxygen such as hydrocarbons, CO2, nitrogen oxide etc. For safety considerations, the limit of this first concentrating operation corresponds to about 10% of the limit of flammability of hydrocarbons in oxygen. The first concentrated stream is then either treated in an on-site purification plant or transported to a central purification center where it is vaporized, heated and treated in a catalytic reactor at high temperature of about 500° C. to remove the hydrocarbons. This oxidation reaction forms CO2 and moisture. The mixture is then dried, its CO2 content is removed in an adsorber. The dried and CO2-free mixture is then cooled and distilled to yield the product which is usually a mixture of Kr and Xe. The product is then further refined to remove oxygen, argon and some other impurities such as CFC compounds, green house gases, remaining traces of hydrocarbons etc. and to yield pure Krypton and pure Xenon as final products.

Kr and Xe are present in very small concentration in atmospheric air (1.14 ppm Kr and 0.086 ppm Xe by volume). Therefore it is currently only economically viable to produce Kr—Xe in large oxygen plants, preferably above 1000 T/D and even larger.

If the purification portion of the process can be a standardized process to refine different types of first concentrated streams, either from an oxygen plant, nitrogen plant, low purity or high purity oxygen plant etc. then the same remark cannot be applied for the process involved to extract a stream containing Krypton and Xenon from the air separation columns. Indeed, because of the above-mentioned variety of air separation plants/processes, it is not possible to have one type of extraction process applicable for all types of air separation plants. For example, a plant producing gaseous oxygen product from the low pressure column would require a different type of rare gases extraction from a plant producing liquid oxygen product for pumping from the low pressure column.

Heavy industrial demand for oxygen for gasification, IGCC, GTL, oxyfuels have increased significantly the size of trains of oxygen plants. Because of the limitation of the size of distillation columns by transport regulations the technological trend in cryogenic process is shifting toward elevated air pressure plants wherein the feed air and the columns' pressure are at higher pressure than traditional oxygen plants. The triple column process is designed to address this type of application and there is a need to provide a technique for extracting rare gases from this type of process.

This triple column process is described in details in several patent such as U.S. Pat. No. 5,231,837, and U.S. Pat. No. 5,341,646.

The technique of recovering Krypton and Xenon from an oxygen plant have been covered extensively in several patents:

U.S. Pat. No. 6,776,004: this prior art taught the technique of recovering rare gases of a mixing column plant for oxygen production. The liquid purge of the low pressure column is treated in an enrichment column reboiled by the top gas of the mixing column to recover the rare gases.

PCT WO 2004/023054: air feeds to the high pressure column is separated into a nitrogen rich stream and 2 oxygen rich liquid streams: rare gases rich liquid and rare gases lean liquid. The rare gases-rich stream is treated in a column located above the crude argon column to yield a Krypton Xenon concentrate at the bottom.

U.S. Pat. No. 6,662,593: the rare gases in the feed air are confined in a rare gases rich liquid stream of the high pressure column and then its oxygen content is stripped in a side column to yield the rare gases concentrate stream. By extracting the rare gases prior to the final distillation in the low pressure column the oxygen product can be quite lean in rare gases and can then be pumped and vaporized to high pressure as final product without incurring losses of rare gases.

U.S. Pat. No. 6,612,129: Krypton and Xenon containing liquid from the high pressure column is partially evaporated in the top condenser of the side-arm argon column of the double column plant. The liquid purge and the vaporized streams of the condenser are then treated in an enrichment column to yield the Krypton Xenon concentrate at the bottom.

U.S. Pat. No. 6,220,054: a column is used to treat the bottom liquid of the crude argon column to yield final oxygen product which is depleted of Krypton and Xenon since the feed to the crude argon column is also depleted in Krypton and Xenon. A stream concentrated in Krypton and Xenon is extracted at the bottom of the low pressure column.

As can be seen, most of the prior art addressed the rare gases recovery for oxygen plant equipped with argon production for high purity oxygen and in some cases, mixing column. Those processes operate at relatively low pressure at about 1.5 to 2 bar in the low pressure column which would yield an air pressure of about 6 to 7.5 bar. Higher pressure than these values would deteriorate the distillation performance especially for the argon recovery. Elevated pressure plant in contrary produces low purity oxygen and operates at about 10 to 16 bar air pressure with the low pressure column operates at about 4 to 6 bar. In order to maintain a good oxygen recovery rate an intermediate column is used to generate more liquid nitrogen reflux from the top of the intermediate column.

SUMMARY

The present invention is a process for recovering rare gases from a multiple column oxygen plant, wherein the multiple column oxygen plant comprises a higher pressure column, a lower pressure column, a middle pressure intermediate column, and a low pressure intermediate column, said middle pressure intermediate column comprising a first bottom reboiler and said low pressure intermediate column comprising a second bottom reboiler. The process includes providing a first oxygen rich liquid stream containing rare gases from the higher pressure column, wherein said first oxygen rich liquid stream is introduced to the first bottom reboiler. The process also includes removing a second oxygen rich liquid stream rich in rare gases from the bottom of the middle pressure intermediate column, wherein said second oxygen rich liquid stream is introduced to the low pressure intermediate column. The process also includes removing a first liquid purge stream concentrated in rare gases is removed from the low pressure intermediate column, wherein said first liquid purge stream is further concentrated downstream. And the process includes removing a third oxygen rich liquid stream lean in rare gases at a location that is at least one tray above the first bottom reboiler, wherein said third oxygen rich liquid stream is introduced to the lower pressure column.

BRIEF DESCRIPTION OF DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
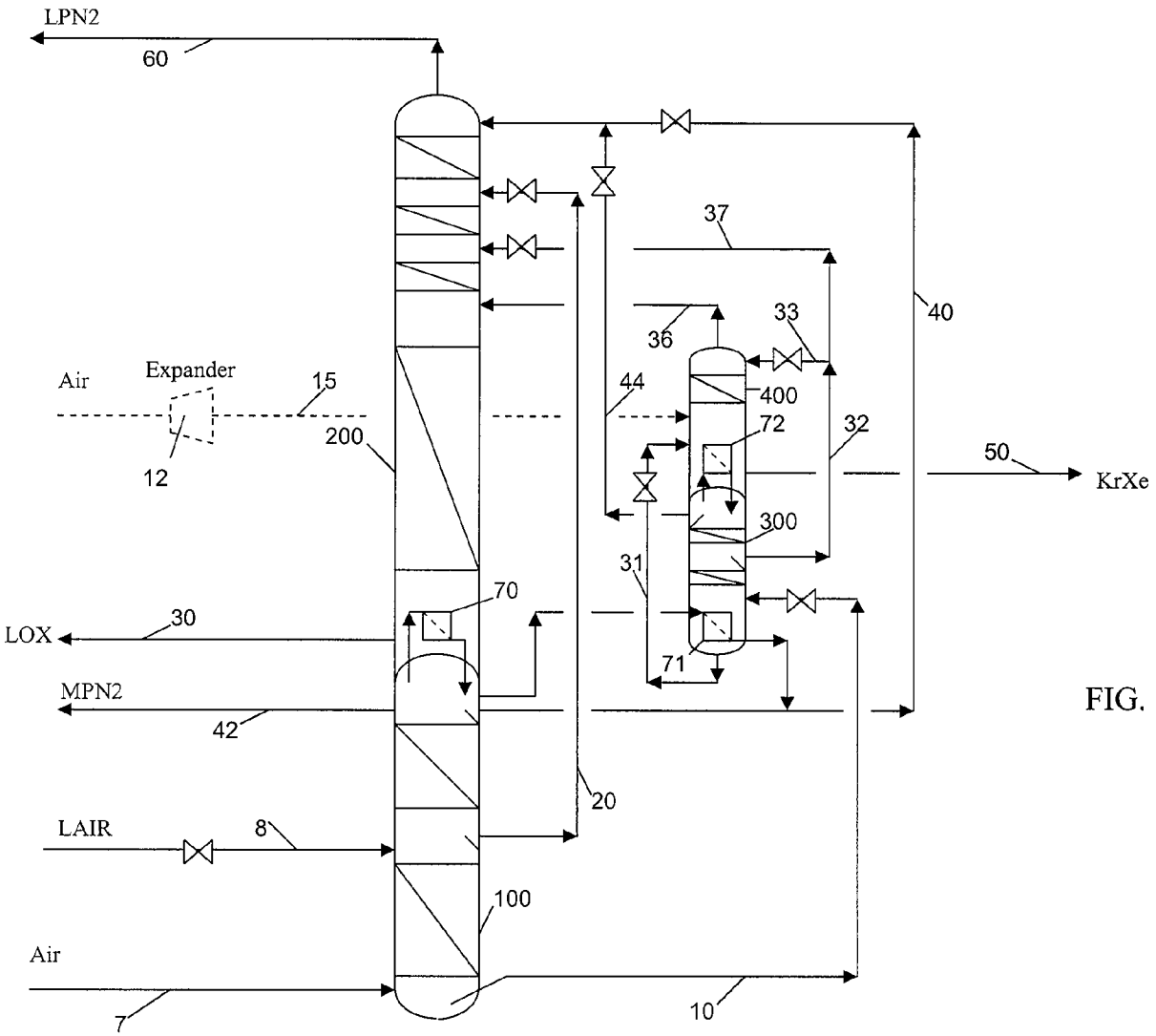
FIG. 1 is a schematic representation of one embodiment of the present invention.

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As illustrated in FIG. 1, elevated pressure air 7 at about 10 to 16 bar is fed to a high pressure column 100 to form a nitrogen rich gas at the top and an oxygen rich liquid 10 at the bottom. A liquid air stream 8 is fed to an intermediate tray location of column 100. A liquid stream 20 with a composition close to liquid air is extracted from the liquid of the tray above the feed tray of liquid air stream 8. Nitrogen rich gas is condensed to yield a first reflux 40 to the low pressure column 200. The oxygen rich liquid 10 is then fed to the bottom reboiler of an intermediate column 300 wherein it is distilled to form a second nitrogen rich gas at the top and a second oxygen rich liquid 31 at the bottom. The second nitrogen rich gas is condensed to yield a second reflux 44 to the low pressure column 200. Stream 20 is fed to column 200 or to both columns 200 and 300. It can be seen that most of the Kr and Xe contained in the air feeds 7 and 8 of the high pressure column is collected in stream 10. Column 300 operates at a pressure lower than column 100's pressure but higher than column 200's pressure. In order to balance out the system a third oxygen rich liquid 32 is extracted at a tray location above the bottom reboiler of column 300. By adopting an adequate tray location and flow of stream 32, it is possible to yield a stream 32 very lean in Kr and Xe and therefore almost all Kr and Xe of the feed stream 10 can be captured in stream 31. Stream 31 is then fed to the bottom reboiler 72 of a column 400, which is reboiled by condensing nitrogen from the top of the intermediate column. This column 400 contains about 5 to 15 theoretical trays and operates at about the same pressure as column 200. A portion 33 of stream 32 is used as reflux for column 400. A liquid purge 50 rich in Kr and Xe is then extracted at the bottom of column 400 for further concentrating operation.

In some plants low pressure air expander 12 expanding air feed into the low pressure column 200 is used. This expanded stream 15 also contained rare gases which would be lost if sent to the low pressure column 200. In this case it is possible to send the expanded air 15 to the bottom of column 400 in order to wash out the contained rare gases and maintaining high recovery of Kr and Xe.

In the process without rare gases production, the bottom stream of the intermediate column 300 is normally divided into 2 portions: the first one is vaporized in the overhead condenser of the intermediate column, the second one is fed as liquid feed to the low pressure column 200. If the same process is applied for rare gases production, the Kr—Xe contained in the second portion of bottom liquid feeding the low pressure column 200 would have been lost in the liquid oxygen product 30. In order to remedy this situation a liquid stream 32 free of Kr—Xe is extracted at a tray located above the bottom reboiler to substitute this second portion of bottom liquid. By doing so the process efficiency is essentially unchanged, and the bottom stream 31 containing the rare gases can be isolated and treated, either in a column or a vaporizer, to recover the rare gases prior to sending it to the low pressure column 200 to produce oxygen. A fraction 33 of stream 32 is used to reflux the KrXe column 400 to further improve the recovery of rare gases.

In reference to the process described in FIG. 1, for a total feed air of 1000 containing 1.14 ppm Kr and 0.086 ppm Xe:

| | Stream | | | | | |
|---|---|---|---|---|---|---|
| | 10 | 32 | 31 | 36 | 33 | KrXe |
| Flow | 454 | 150 | 225 | 254 | 34 | 5 |
| ppm Kr | 2.49 | 0.26 | 4.9 | 0.04 | 0.26 | 219 |
| ppm Xe | 0.19 | 0.00012 | 0.38 | 0 | 0.00012 | 17.2 |

ppm: parts per million by volume

In this process simulation, stream 32 is extracted at 2 trays above the bottom reboiler. In another embodiment, stream 32 may be extracted at least one tray above the bottom reboiler. Range of composition of stream 31:

about 5.5 ppm to 3 ppm Kr about 0.5 ppm to 0.3 ppm Xe

Stream 32 has very low content of Kr and Xe, preferably a maximum at about 1.5 ppm of Kr and 0.01 ppm Xe. The rich liquid 10 is fed to the bottom of the intermediate column.

Figure 2:
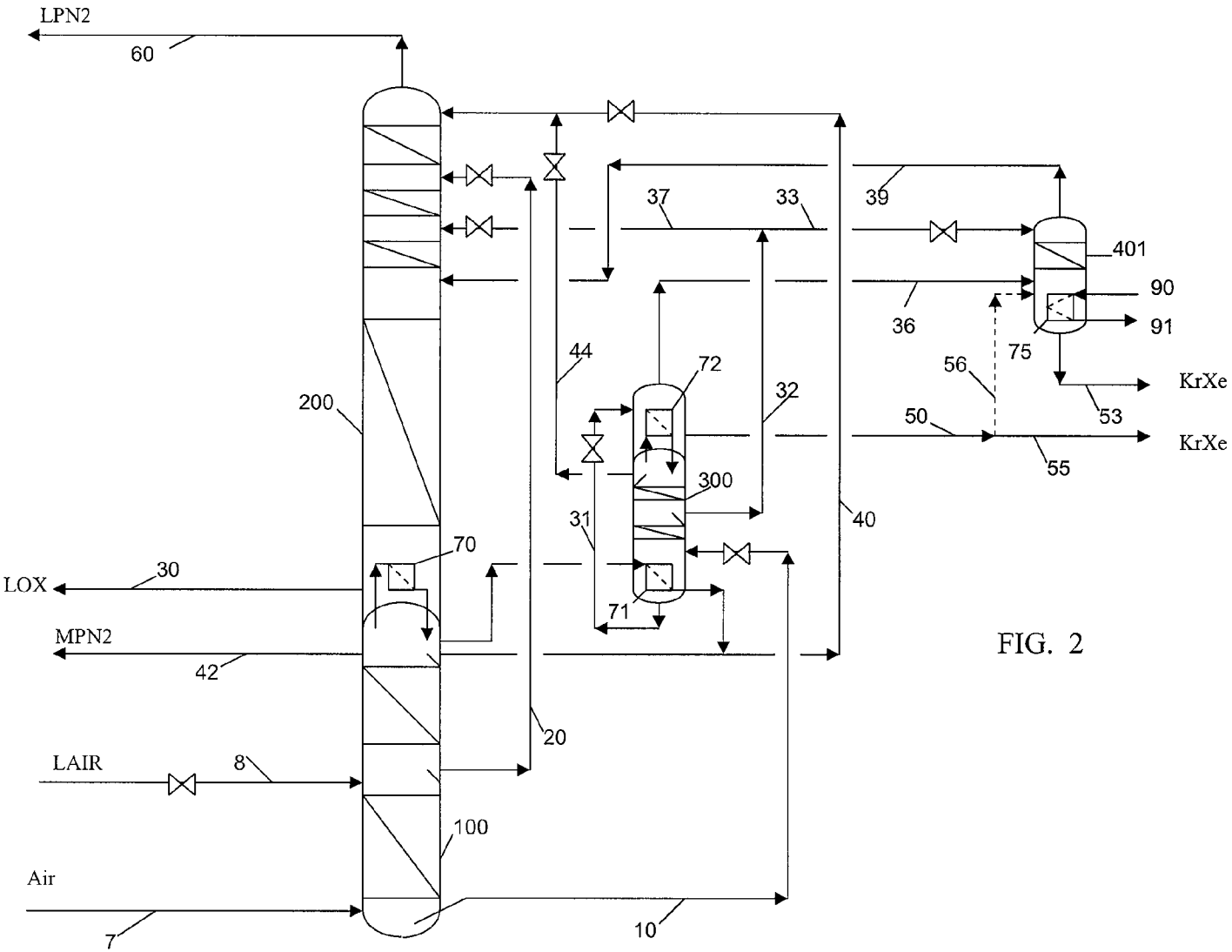
FIG. 2 is a schematic representation of another embodiment of the present invention.

In another embodiment described in FIG. 2, the vaporized stream 36 from condenser 72 is treated in a short column 401 to recover the Kr and Xe carried over in stream 36. Column 401 operates at about the same pressure as the low pressure column 200. Column 401 is refluxed by a portion 33 of stream 32. The reboil of column 401 can be supplied by heating the bottom reboiler 75 with any suitable stream such as air, nitrogen, oxygen rich liquid, liquid air etc. The liquid purge stream 50 of the top condenser can be optionally sent to the bottom of column 401 and the combined collected Kr and Xe is recovered is bottom stream 53. Again, the expanded air stream (not shown), if existed, can be fed to the bottom of column 401 to recover its rare gases content.

Figure 3:
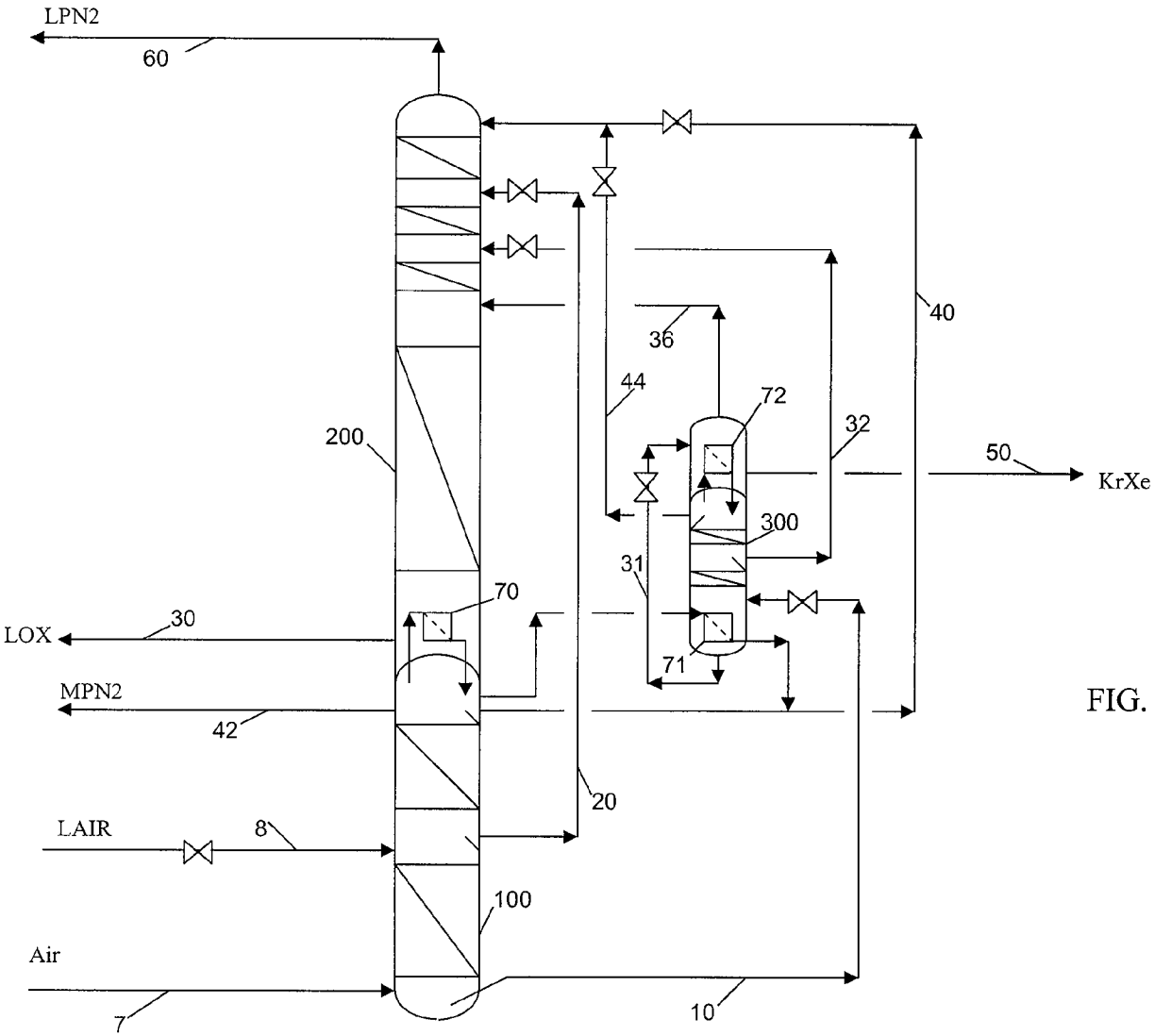
FIG. 3 is a schematic representation of another embodiment of the present invention

It is also possible to just vaporize the bottom liquid 31 in the condenser 72 without the use of the column 400 or 401 as illustrated in FIG. 3. The Krypton recovery will be reduced significantly because of the carry-over of Kr and, at a lesser proportion, of Xenon in the vaporized stream 36. This process is slightly simpler and can be used in cases when Krypton recovery does not need to be very high.

A Krypton recovery higher than 96% and a Xenon recovery higher than 99% in the liquid purge bottom are expected for this type of process as illustrated in FIGS. 1 and 2.

What is claimed is:

1. A process recovering rare gases from a multiple column oxygen plant, wherein the multiple column oxygen plant comprises a higher pressure column, a lower pressure column, a middle pressure intermediate column, and a low pressure intermediate column, said middle pressure intermediate column comprising a first bottom reboiler and said low pressure intermediate column comprising a second bottom reboiler, the process comprising the steps of:

providing a first oxygen rich liquid stream containing rare gases from the higher pressure column and introducing said first oxygen rich liquid stream to the middle pressure intermediate column at a location near the fist bottom reboiler;

removing a second oxygen rich liquid stream rich in rare gases from the bottom of the middle pressure intermediate column and introducing said second oxygen rich liquid stream to the low pressure intermediate column;

removing a first liquid purge stream concentrated in rare gases from the low pressure intermediate column; and removing a third oxygen rich liquid stream lean in rare gases at a location that is at least one tray above the first bottom reboiler and introducing said third oxygen rich liquid stream to the lower pressure column, wherein the middle pressure intermediate column and the low pressure intermediate column are thermally coupled via the second bottom reboiler such that the second bottom reboiler acts as a reboiler for the low pressure intermediate column and a condenser for the middle pressure intermediate column.

2. The process of claim 1, wherein said middle pressure intermediate column has a pressure that is greater than that of the low pressure column, and lower than that of the high pressure column.

3. The process of claim 1, wherein said low pressure intermediate column has a pressure that is about the same as that of the low pressure column.

4. The process of claim 1, wherein the multiple column oxygen plant further comprises a low pressure air expander, the process further comprising the steps of:

expanding air feed in the low pressure air expander, and introducing said expanded air feed to a bottom portion of the low pressure intermediate column.

5. The process of claim 1, wherein the first liquid purge stream comprises a Krypton recovery of at least 80%.

6. The process of claim 1, wherein the first liquid purge stream comprises a Xenon recovery of at least 80%.

7. A process recovering rare gases from a multiple column oxygen plant, wherein the multiple column oxygen plant comprises a higher pressure column, a lower pressure column, and an intermediate column, said intermediate column comprising a bottom reboiler and a top condenser, the process comprising the steps of:

providing a first oxygen rich liquid stream containing rare gases from the higher pressure column, and introducing said first oxygen rich liquid stream to the intermediate column at a location near the bottom reboiler, such that at least a portion of the first oxygen rich liquid stream is heated by the bottom reboiler;

removing a second oxygen rich liquid stream rich in rare gases from the bottom of the intermediate column, and vaporizing said second oxygen rich liquid stream in the top condenser; thereby producing a vaporized oxygen rich stream and a liquid purge stream concentrated in rare gases, removing the liquid purge stream concentrated in rare gases from the top condenser; and removing a third oxygen rich liquid stream lean in rare gases at a location that is at least one tray above the bottom reboiler, and introducing said third oxygen rich liquid stream to the lower pressure column.

8. The process of claim 7, wherein the multiple column oxygen plant further comprises a short column, the process further comprising the step of:

introducing the vaporized oxygen rich stream from the top condenser to the short column, wherein a second liquid purge stream rich in rare gases is removed from the bottom of the short column.

9. The process of claim 8, wherein said short column has a pressure that is about the same as the pressure of low pressure column.

10. The process of claim 1, wherein the higher pressure column receives pressurized air at about 10 to 16 bar.

11. The process of claim 1, wherein the first liquid purge stream is removed at a location near the second bottom reboiler.

12. The process of claim 1, wherein a nitrogen gas stream from the higher pressure column provides heat to the first bottom reboiler.

13. The process of claim 8, wherein the lower pressure column and the higher pressure column are thermally coupled.

14. The process of claim 8, wherein a nitrogen gas stream from the higher pressure column provides heat to the bottom reboiler.

15. A process for recovering rare gasses from a multiple column oxygen plant, wherein the multiple column oxygen plant comprises a higher pressure column, a lower pressure column, a middle pressure intermediate column, and a low pressure intermediate column, said middle pressure intermediate column comprising a first bottom reboiler and said low pressure intermediate column comprising a second bottom reboiler, wherein the second bottom reboiler of the low pressure intermediate column acts as a condenser for the middle pressure intermediate column, such that vapor leaving the middle pressure intermediate column has substantially the same composition as condensate leaving the second bottom reboiler, the process comprising the steps of:

providing a first oxygen rich liquid stream containing rare gases from the higher pressure column and introducing said first oxygen rich liquid stream to the middle pressure intermediate column at a location near the first bottom reboiler;

removing a second oxygen rich liquid stream rich in rare gases from the bottom of the middle pressure intermediate column and introducing said second oxygen rich liquid stream to the low pressure intermediate column;

removing a first liquid purge stream concentrated in rare gases from the low pressure intermediate column; and removing a third oxygen rich liquid stream lean in rare gases at a location that is at least one tray above the first bottom reboiler and introducing said third oxygen rich liquid stream to the lower pressure column.

* * * * *